US008826840B1

(12) United States Patent
Slack

(10) Patent No.: US 8,826,840 B1
(45) Date of Patent: Sep. 9, 2014

(54) COLLAPSIBLE MAST AND RIGGING FOR A SAILBOAT

(76) Inventor: Byron Slack, Battle Ground, WA (US)

( * ) Notice: Subject to any disclaimer, the term of this patent is extended or adjusted under 35 U.S.C. 154(b) by 135 days.

(21) Appl. No.: 13/567,811

(22) Filed: Aug. 6, 2012

(51) Int. Cl.
*B63H 9/04* (2006.01)

(52) U.S. Cl.
USPC ..... 114/90; 114/113

(58) Field of Classification Search
USPC ..... 114/90, 108, 11, 112, 113, 111
IPC ..... B63H 9/08
See application file for complete search history.

(56) References Cited

U.S. PATENT DOCUMENTS

| | | | | |
|---|---|---|---|---|
| 151,169 | A * | 5/1874 | Solomon | 114/113 |
| 1,907,024 | A * | 5/1933 | Willard et al. | 254/93 R |
| 4,016,823 | A * | 4/1977 | Davis | 114/90 |
| 4,823,718 | A * | 4/1989 | Dale | 114/113 |
| 6,000,354 | A | 12/1999 | Vanlerberghe | |
| 6,526,901 | B2 * | 3/2003 | Iacoboni | 114/90 |

* cited by examiner

*Primary Examiner* — Stephen Avila
(74) *Attorney, Agent, or Firm* — Portland Intellectual Property, LLC

(57) ABSTRACT

A collapsible mast and rigging for a sailboat. A collapsible mast is provided having a base section and one or more telescopic sections. A plurality of mast rings are also provided, each mast ring having a sail attachment portion for attaching the mast ring to the sail of the sailboat, and a ring-shaped portion for fitting around a selected one of the telescopic sections and, thus fitted, sliding on the outer surface thereof. A hydraulic fluid pump may be used to power the collapsible mast.

16 Claims, 4 Drawing Sheets

Fig. 7
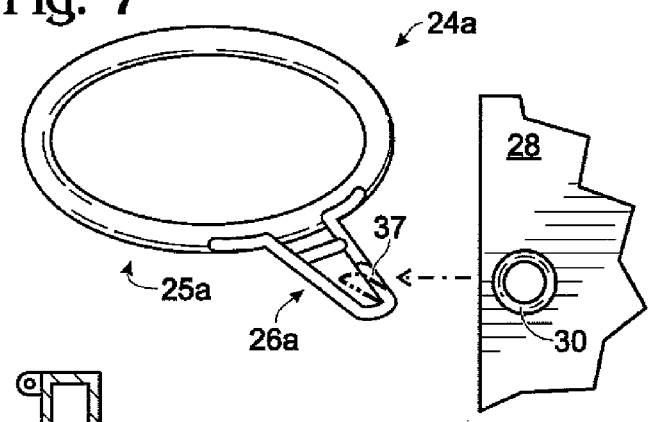
Fig. 3
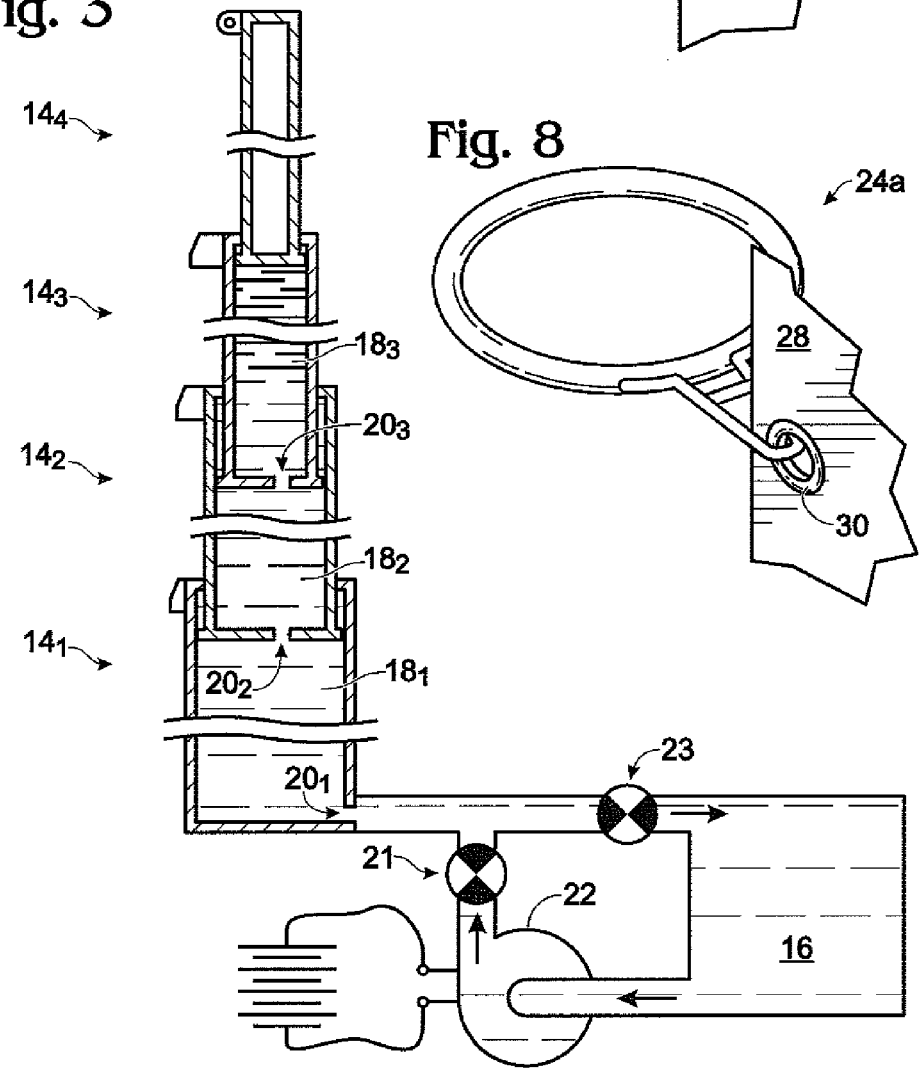
Fig. 8

COLLAPSIBLE MAST AND RIGGING FOR A SAILBOAT

FIELD OF THE INVENTION

The present invention relates to collapsible mast and rigging for a sailboat.

BACKGROUND

It is frequently required to take down the mast of a sailboat, for trailering the sailboat or for passing the sailboat underneath a low bridge. This is a difficult task requiring above average skill.

As one prior art solution to this problem, U.S. Pat. No. 6,000,354 proposes a telescoping mast, having a base or trunk portion supporting a telescoping portion. The telescoping portion can be raised sufficiently by pulling on a flexible line or cable to unseat a spring-biased fork that supports the telescoping portion in a raised position, allowing the telescoping portion to be lowered under its own weight into the trunk portion. The trunk portion also pivots about an axle so that the mast is lowered as a result of being brought more nearly in alignment with the deck of the sailboat at the same time that it is collapsing in length.

One problem with the rigging proposed in the '354 patent is that the sail remains extended in the lowered position and so remains capable of being blown about when that is not desired.

It is an object of the present invention to provide for an improved collapsible mast and rigging for a sailboat.

SUMMARY

Disclosed is collapsible mast and rigging for a sailboat. For use as a mast and rigging for a sailboat, a collapsible mast is provided having a base section and one or more telescopic sections, along with a plurality of mast rings. Each mast ring has a sail attachment portion for attaching the mast ring to the sail of the sailboat, and a ring-shaped portion for fitting around a selected one of the telescopic sections and, thus fitted, sliding on the outer surface thereof.

The following additional features may be provided in any suitable combination.

Preferably, the telescopic sections have cylindrically shaped exterior surfaces, and each mast ring has a circularly shaped portion for fitting around the cylindrically shaped exterior surface of the selected telescopic section.

Preferably, respective interior surfaces of the circularly shaped portions of the mast rings each have a polymeric bearing material for making contact with the selected telescopic section.

For powering the collapsible mast, a hydraulic fluid pump may be provided. In that case, the base section and the one or more telescopic sections each have internal cavities in fluid communication with each other and with said pump, the cavities being adapted so that fluid pressure therein produced by the pump causes the one or more telescopic sections to telescope apart, thereby causing the collapsible mast to adopt an extended configuration.

The pump has an inlet and an outlet, and preferably a fluid holding tank is provided in fluid communication with the inlet. Preferably in addition, the cavities are capable of being in fluid communication with the holding tank by operation of a valve.

Preferably, the base section and at least one of the telescopic sections have associated cable guides depending therefrom at a predetermined azimuth, the rigging further comprising a cable adapted for passage through the cable guides to substantially prevent relative azimuthal rotation of the base section and the at least one telescopic section.

A sailboat is also disclosed having a collapsible mast mounted thereto, the collapsible mast having a base section and one or more telescopic sections, wherein the telescopic sections have cylindrically shaped exterior surfaces.

The following additional features may be provided in any suitable combination.

Preferably, there are a plurality of mast rings, each mast ring has a sail attachment portion for attaching the mast ring to the sail of the sailboat, and a ring-shaped portion for fitting around a selected one of the telescopic sections and, thus fitted, sliding on the outer surface thereof, and each mast ring has a circularly shaped portion for fitting around the cylindrically shaped exterior surface of the selected telescopic section.

Preferably, respective interior surfaces of the circularly shaped portions of the mast rings each have a polymeric bearing material for making contact with the selected telescopic section.

For powering the collapsible mast, a hydraulic fluid pump may be provided. In that case, the base section and the one or more telescopic sections each have internal cavities in fluid communication with each other and with said pump, the cavities being adapted so that fluid pressure therein produced by the pump causes the one or more telescopic sections to telescope apart, thereby causing the collapsible mast to adopt an extended configuration.

The pump has an inlet and an outlet, and preferably a fluid holding tank is provided in fluid communication with the inlet. Preferably in addition, the cavities are capable of being in fluid communication with the holding tank by operation of a valve.

Preferably, the base section and at least one of the telescopic sections have associated cable guides depending therefrom at a predetermined azimuth, the rigging further comprising a cable adapted for passage through the cable guides to substantially prevent relative azimuthal rotation of the base section and the at least one telescopic section.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

BRIEF DESCRIPTION OF DRAWINGS

FIG. 3 is cross-sectional view of the mast of FIG. 1 combined with a schematic view of a fluid holding and pumping system for extending and collapsing the mast.

FIG. 7 is an isometric view of an alternative mast ring according to the invention, illustrating a manner of attaching the sail of the sailboat thereto.

FIG. 8 is an isometric view of the mast ring of FIG. 7 showing the sail of the sailboat attached thereto.

DETAILED DESCRIPTION OF PREFERRED EMBODIMENTS

Figure 1:
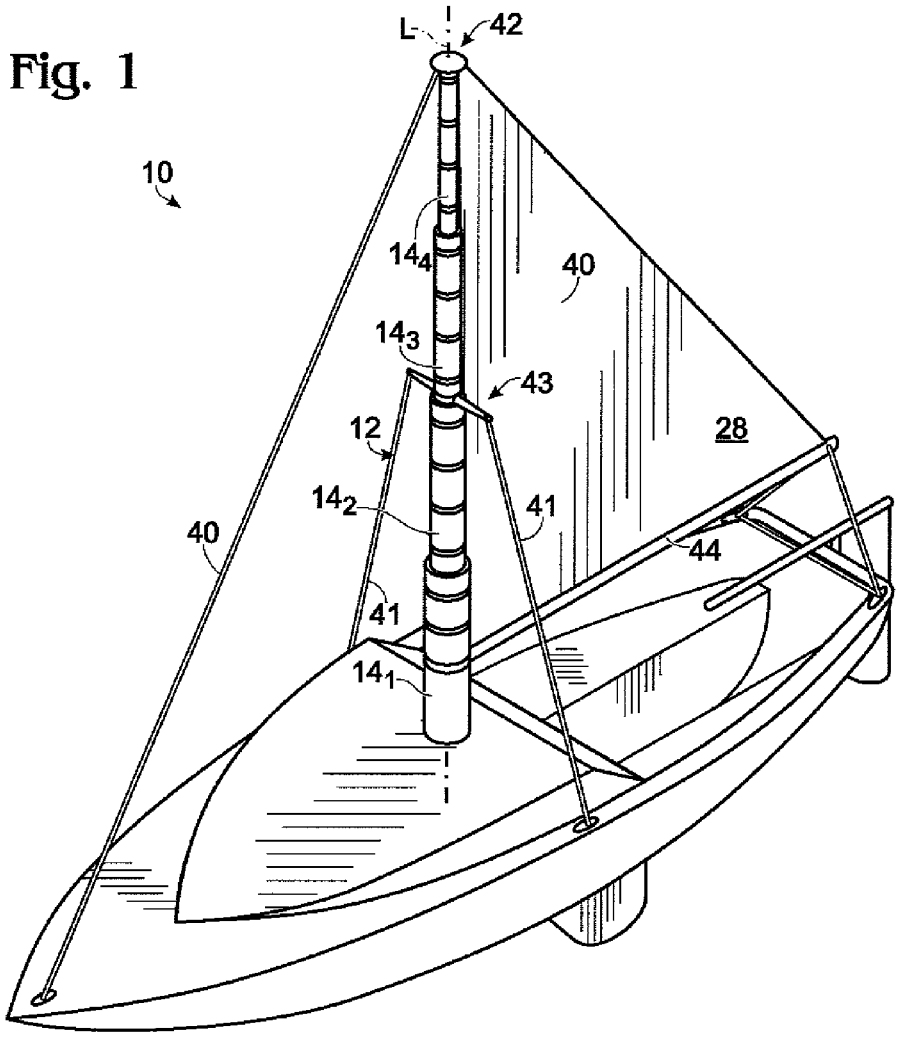
FIG. 1 is an isometric view of a sailboat with a collapsible mast and rigging according to the invention, including a telescopic mast and a plurality of mast rings for connecting a sail to the mast.

FIG. 1 shows a sailboat 10 with an elongate, collapsible mast 12 according to the invention defining an elongate axis "L" that is oriented substantially vertically. In a small sailboat that is about 14 feet in length, the mast is about 20 feet in height when fully extended; but the sailboat may be of any size, and the mast may be of any height.

The mast 12 has a fixed base section $\mathbf{14}_1$ and one or more telescopic sections $\mathbf{14}_n$ (the minimum value of "n" being 2) supported by the base section. Typically, there are three such telescopic sections (i.e., "n"=2, 3, and 4) $\mathbf{14}_2$, $\mathbf{14}_3$, and $\mathbf{14}_4$.

Figure 2:
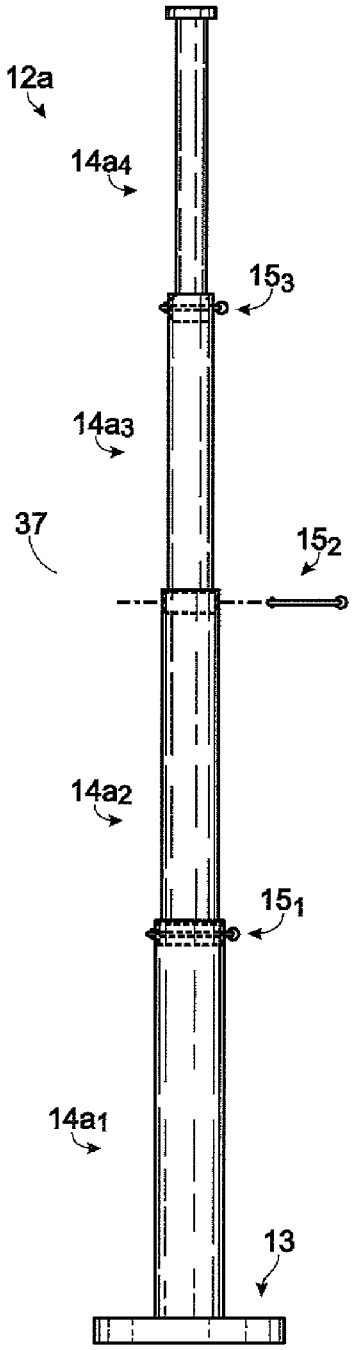
FIG. 2 is an isometric view of the mast of FIG. 1 erected manually into an extended configuration with the use of pins.

In a small sailboat, such as where the mast may be about 20 feet or less in length when fully extended, the mast will generally be light enough that it can be raised, section by section, by hand, even considering the weight of the sail and the tension of the rigging. FIG. 2 shows such a mast 12*a*, with a base mast section $\mathbf{14}a_1$ and three telescopic mast sections $\mathbf{14}a_1$ $\mathbf{14}a_4$ pinned, respectively, by use of pins $\mathbf{15}_1$-$\mathbf{15}_3$, to the adjacent mast section therebeneath, which the user manually inserts through corresponding holes in the mast sections. For example, the user may first pin the section $\mathbf{14}a_4$ to the section $\mathbf{14}a_3$ with the pin $\mathbf{15}_3$; next the user may pin the section $\mathbf{14}a_3$ to the section $\mathbf{14}a_2$ with the pin $\mathbf{15}_2$; and finally the user may pin the section $\mathbf{14}a_2$ to the section $\mathbf{14}a_1$ with the pin $\mathbf{15}_1$. Preferably, the mast sections are cylindrical in shape, to allow for the rotation of a mast ring structure as discussed below, and preferably they are also hollow, to minimize weight.

With reference to FIG. 3, in a larger sailboat where manual raising of the mast is not desirable or practical, the telescopic sections are preferably raised to adopt an extended configuration of the mast 12 according to the invention by pressurized hydraulic fluid (not shown). The hydraulic fluid is initially stored in a fluid holding tank 16, and is pumped into respective interior cavities $\mathbf{18}_n$ of all but the top-most section, through corresponding fluid entry ports $\mathbf{20}_n$ therein, by a hydraulic pump 22 which is typically battery powered. The extended configuration may be maintained by closing a valve 21 between the outlet of the pump and the entry port $\mathbf{20}_1$.

The top-most mast section, here $\mathbf{14}_4$, is preferably hollow as shown to minimize weight, but this is not essential.

To collapse the telescopic sections and thereby lower the mast, with the pump turned off, a valve 23 which was previously closed is either manually or automatically opened to allow the hydraulic fluid 15 to drain back into the holding tank 16, the fluid being forced out of the cavities 18, by the weight of the telescopic sections. If the sailboat has a deep keel, it may be desirable to build the non-collapsible base section $\mathbf{14}_1$ into the keel to allow for a maximum degree of lowering of the mast.

As is standard practice in the art of hydraulics, the exterior surfaces of the telescopic sections are cylindrical, as are the interior surfaces of the base section and each of the telescopic sections that supports another telescopic section; that is, all sliding surfaces are cylindrical.

The mast sections are preferably formed of a corrosion resistant material. The material preferably has a low density but it should also be sufficiently strong to withstand internal fluid pressures of 30-60 psi (for example, if a mast section diameter is 3 inches (area about equal to 28 square inches) and the weight the mast section must support (with the sail and all rigging attached) is 1000 pounds, the fluid pressure would need to be about 35 psi, the required fluid pressure being greater for decreasing mast section diameters. Aluminum or stainless steel are some examples of preferred metal materials, and plastic materials could be used.

Each mast section is closely toleranced to mate with seals (not shown) incorporated into the mast section into which it is received to prevent leakage of the hydraulic fluid such as might otherwise occur at the interface between the sections $\mathbf{14}_1$ and $\mathbf{14}_2$ indicated as "A" in FIG. 3, for example. It is advantageous to use oil as the hydraulic fluid and allow for some leakage, however, so that the sliding surfaces that are exposed to the elements when the mast is in its extended configuration have a light coating of oil to help resist corrosion. Preferably, mineral oil is used as the hydraulic fluid so that leakage poses minimal risk of environmental harm; however, any non-compressible, lubricious fluid may be used as the hydraulic fluid.

Figure 4:
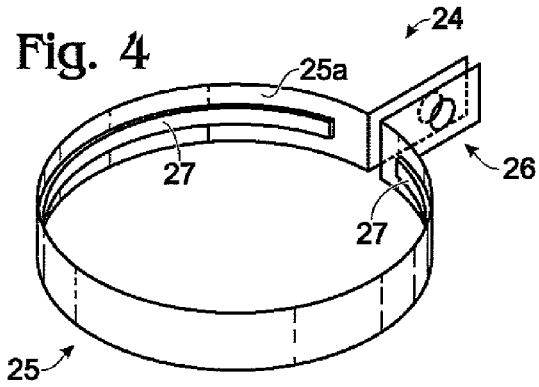
FIG. 4 is an isometric view of one of the mast rings of FIG. 1.
Figure 5:
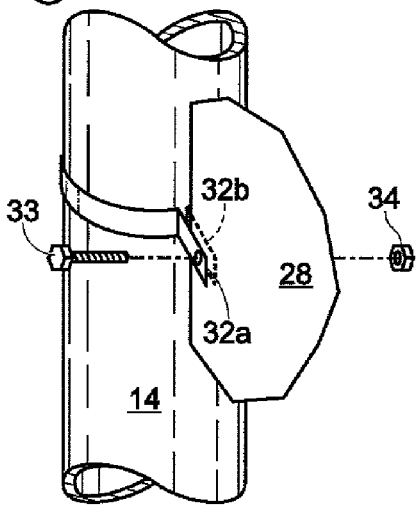
FIG. 5 is an isometric view of one of the mast rings of FIG. 1 shown attached to a cut-away portion of the mast of FIG. 1.

FIG. 4 shows a typical mast ring 24 according to the invention, for attaching a sail 28 to the mast 12, and FIG. 5 shows the mast ring in place around one of the mast sections 14. The mast ring has a ring-shaped portion 25 for surrounding the mast section, and a sail-attachment portion 26 for attaching to the sail.

For reasons to be discussed below, the mast ring 24 is loosely fitted to a mast section so that the mast ring can rotate about the mast section, and so that it can slide up and down on the mast section. So it is important that the mast ring 24 not damage the sliding surfaces around which it is fitted. Thus the interior surface 25*a* of the ring-shaped portion 25 is provided with a lubricious, relatively soft bearing material 27 (i.e., as compared to the material of the mast section), such as PTFE (aka TEFLON®) or acetyl resin (aka DELRIN®). The bearing material may be applied to the surface 25*a* as a coating or attached thereto as a preform by use of inset fasteners or adhesives. As will be readily appreciated, it is not essential that the entire interior surface area 25*a* be covered by bearing material.

Figure 6:
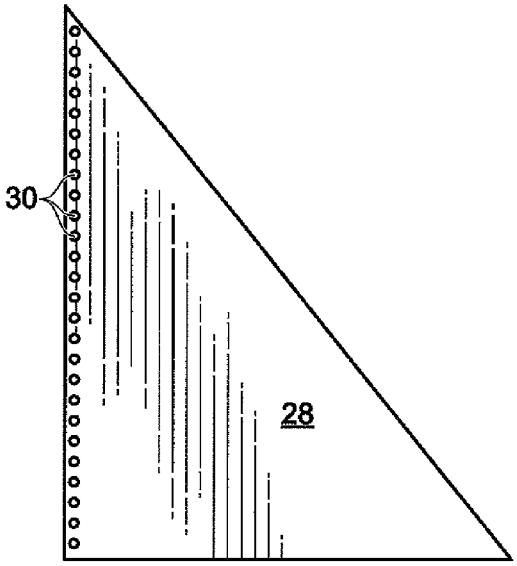
FIG. 6 is side elevation of the sail of FIG. 1.

FIG. 6 shows a sail 28 that has been provided with grommets 30 according to the invention. Referring back to FIG. 5, the grommets 30 provide through-holes to be captured between tabs 32 (32*a*, 32*b*) of the sail-attachment portion 26 of the mast ring 24 that, preferably, have corresponding holes so that a bolt 33 and lock-nut 34 can be used to fasten the sail to the mast ring. However, many alternative mounting arrangements can be used.

FIGS. 7 and 8 show an alternative mast ring 24*a* and its manner of attachment to the sail 28. A latch 27 of a sail-attachment portion 26*a* as shown in FIG. 7 is spring-biased to remain closed and thereby retain the sail via the grommet 30 as shown in FIG. 8. A ring-shaped portion 25*a* may be formed of steel rod that is dipped in a lubricious coating material.

Figure 9:
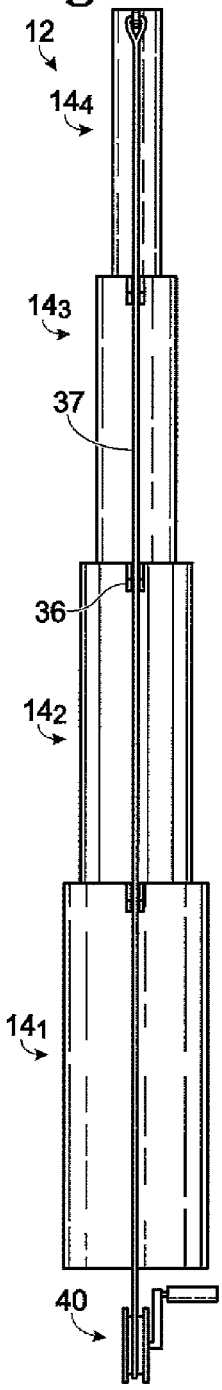
FIG. 9 is front elevation of the mast of FIG. 1.
Figure 10:
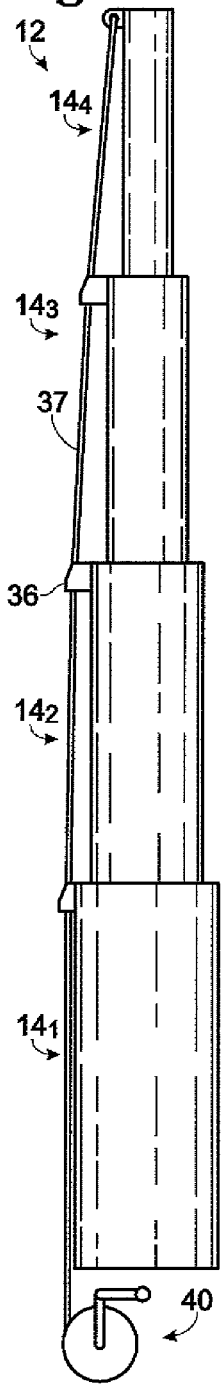
FIG. 10 is a side elevation of the mast of FIG. 9.

FIGS. 9 and 10 show the mast 12 in the fully extended configuration so as to highlight a rotational control feature of the invention. The diameters of the base and telescopic sections 14 are exaggerated for illustrative purposes. A cable guide which may be in the form of a pair of spaced apart, vertically oriented tabs 36 is preferably provided at or near the top of each of the mast sections, for guiding therebetween a cable 37 that extends from the top of the top-most mast section (here $\mathbf{14}_4$) down to a winch 40, which may be located at the bottom of the base section $14_1$, or which may be located remote from the mast by use of a suitably provided pulley system. Many alternative configurations of the cable guide could be used.

The cable is tightened when the mast is fully extended and prevents the mast sections from rotating azimuthally relative to each other. Since the base section is mounted to the sailboat, the telescoping sections are thereby likewise constrained to remain at a substantially fixed azimuthal orientation relative to the boat.

On the other hand, the loose fitting mast rings allow the sail to rotate about the mast, and this is believed to be desirable to allow the leading edge of the sail to better align itself with the wind-stream than the current methods for mounting a sale to a mast, by which the leading edge of the sail is installed as a tongue into a groove in the mast, allows.

Figure 11:
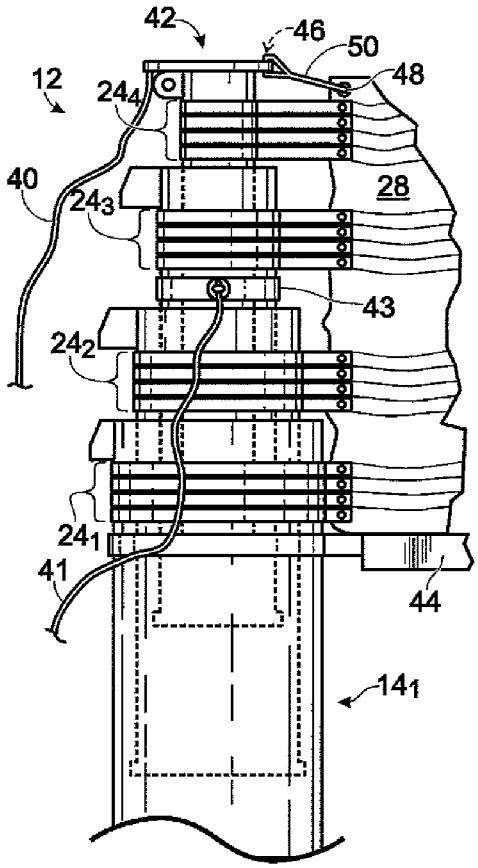
FIG. 11 is a side elevation of the mast and mast rings of FIG. 1 with the mast in a collapsed configuration.

The loose fitting nature of the mast rings allows the telescopic sections to collapse, by allowing the mast rings to become stacked one on top of the other as shown in FIG. 11. The mast rings collapse until they are stopped by the projecting tabs 36 of the telescopic section to which the mast rings are fitted, and the tabs 36 of the mast section immediately below.

FIG. 11 also shows an optional upward adjustment of the boom 44 relative to its position in FIG. 1, for the purpose of maximally collapsing the sail 28, to facilitate wrapping it in a shroud for road transport. Thus the four mast rings referenced as $24_1$ can be caused to slide vertically upwardly by the user independently of the remaining mast rings $24_2$-$24_4$ sliding vertically downwardly as a result of the collapse of the mast.

Finally, FIG. 11 shows a sail support cable 50 attached to the connector 42 at 46 and to the sail 28 at 48, to support the sail and allow it to pivot about the mast, as the mast rings are preferably loosely fitted enough to the mast sections that they will not be able to provide this support. However, the mast rings could be secured more tightly to the mast sections so that they would be able to support the sail if desired.

Referring back to FIG. 1, a connector 42 for guy cables 40 is preferably provided at the top-most telescopic section $14_n$ for anchoring the mast against bending forces in the standard manner; and a connector 43 for guy cables 41 is provided at about half-mast. The connector 42 may be rigidly attached at the top of the top-most telescopic section $14a_n$, but the connector 43 has a ring-shaped portion like the that of the mast rings 24, so that it can be attached to its mast section in like manner and therefore so that it can slide on the mast section the same as a mast ring. With the mast in its extended configuration, the connector 43 is normally supported by the junction between two adjacent mast sections, e.g., where the connector 43 is fitted around the mast section $14_3$, it is supported by the ledge defined by the larger diameter mast section $14_2$ immediately below. Alternatively, it could be supported at an intermediate position by use of another cable supported by the connector 42, analogous to the cable 50. As shown in FIG. 11, when the mast is collapsed, the connector 43 collapses with the mast rings, and the guy cables 40 and 41 become slackened, along with the sail.

Returning to FIG. 2, the base section of any mast 12 according to the invention typically has a foot 13 to which the base section is attached. The foot 13 is shown as a flat plate for mounting to a flat, level surface, but it should be understood that the foot 13 could have any configuration or orientation appropriate for anchoring the mast to the sailboat.

The foot 13 is preferably formed of a strong corrosion resistant metal, such as stainless steel or aluminum, and where the mast is also formed of metal, the foot 13 is preferably formed of the same metal to avoid creating a galvanic potential.

The foot 13 may be welded, bolted, or otherwise fastened directly to a suitably strong, metal surface of the sailboat such as the deck or hull, or it may be fastened to plates or brackets attached to the sailboat. For example, where the sailboat is formed of fiberglass, the foot 13 may be fastened to a flat metal plate originally embedded in the fiberglass or "glassed in" later. Alternatively, as noted previously, it may be desirable to fit the base section into the keel, and as will be readily appreciated by persons of ordinary mechanical skill, there are many ways this could be done.

It is to be understood that, while a specific collapsible mast and rigging for a sailboat has been shown and described as preferred, other configurations could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A collapsible mast and rigging for a sailboat, comprising:

a collapsible elongate mast defining an elongate axis, the mast having a base section and one or more telescopic sections, each telescopic section having a cylindrical outer surface; and a plurality of mast rings, each mast ring having a sail attachment portion for attaching the mast ring to the sail of the sailboat, and a ring-shaped portion for loosely fitting around a selected one of the telescopic sections, the loose fitting to provide for sliding the mast ring along the elongate axis on the outer surface of the telescopic section in response to raising or lowering the telescopic section, and rotating the mast ring about the telescopic section in response to wind forces applied to the sail.

2. The mast and rigging of claim 1, wherein respective interior surfaces of the mast rings each have a polymeric bearing material for making contact with the selected telescopic section.

3. The mast and rigging of claim 2, including the sail.

4. The mast and rigging of claim 1, including the sail.

5. The mast and rigging of claim 2, wherein the base section and at least one of the telescopic sections have associated cable guides depending therefrom at a predetermined azimuth, the rigging further comprising a cable adapted for passage through the cable guides to substantially prevent relative azimuthal rotation of the base section and said at least one telescopic section.

6. The mast and rigging of claim 5, further comprising a hydraulic fluid pump, wherein said base section and said one or more telescopic sections each have internal cavities in fluid communication with each other and with said pump, said cavities being adapted so that fluid pressure therein produced by said pump causes the one or more telescopic sections to telescope apart, thereby causing the collapsible mast to adopt an extended configuration.

7. The mast and rigging of claim 4, further comprising a hydraulic fluid pump, wherein said base section and said one or more telescopic sections each have internal cavities in fluid communication with each other and with said pump, said cavities being adapted so that fluid pressure therein produced by said pump causes the one or more telescopic sections to telescope apart, thereby causing the collapsible mast to adopt an extended configuration.

8. The mast and rigging of claim 3, further comprising a hydraulic fluid pump, wherein said base section and said one or more telescopic sections each have internal cavities in fluid communication with each other and with said pump, said cavities being adapted so that fluid pressure therein produced by said pump causes the one or more telescopic sections to telescope apart, thereby causing the collapsible mast to adopt an extended configuration.

9. The mast and rigging of claim 2, further comprising a hydraulic fluid pump, wherein said base section and said one or more telescopic sections each have internal cavities in fluid communication with each other and with said pump, said cavities being adapted so that fluid pressure therein produced by said pump causes the one or more telescopic sections to telescope apart, thereby causing the collapsible mast to adopt an extended configuration.

10. The mast and rigging of claim 1, further comprising a hydraulic fluid pump, wherein said base section and said one or more telescopic sections each have internal cavities in fluid communication with each other and with said pump, said cavities being adapted so that fluid pressure therein produced by said pump causes the one or more telescopic sections to telescope apart, thereby causing the collapsible mast to adopt an extended configuration.

11. The mast and rigging of claim 4, wherein the base section and at least one of the telescopic sections have associated cable guides depending therefrom at a predetermined azimuth, the rigging further comprising a cable adapted for passage through the cable guides to substantially prevent relative azimuthal rotation of the base section and said at least one telescopic section.

12. The mast and rigging of claim 3, wherein the base section and at least one of the telescopic sections have associated cable guides depending therefrom at a predetermined azimuth, the rigging further comprising a cable adapted for passage through the cable guides to substantially prevent relative azimuthal rotation of the base section and said at least one telescopic section.

13. The mast and rigging of claim 1, wherein the base section and at least one of the telescopic sections have associated cable guides depending therefrom at a predetermined azimuth, the rigging further comprising a cable adapted for passage through the cable guides to substantially prevent relative azimuthal rotation of the base section and said at least one telescopic section.

14. The mast and rigging of claim 13, further comprising a hydraulic fluid pump, wherein said base section and said one or more telescopic sections each have internal cavities in fluid communication with each other and with said pump, said cavities being adapted so that fluid pressure therein produced by said pump causes the one or more telescopic sections to telescope apart, thereby causing the collapsible mast to adopt an extended configuration.

15. The mast and rigging of claim 12, further comprising a hydraulic fluid pump, wherein said base section and said one or more telescopic sections each have internal cavities in fluid communication with each other and with said pump, said cavities being adapted so that fluid pressure therein produced by said pump causes the one or more telescopic sections to telescope apart, thereby causing the collapsible mast to adopt an extended configuration.

16. The mast and rigging of claim 11, further comprising a hydraulic fluid pump, wherein said base section and said one or more telescopic sections each have internal cavities in fluid communication with each other and with said pump, said cavities being adapted so that fluid pressure therein produced by said pump causes the one or more telescopic sections to telescope apart, thereby causing the collapsible mast to adopt an extended configuration.

* * * * *